US011318577B2

(12) United States Patent
Elkhatib et al.

(10) Patent No.: US 11,318,577 B2
(45) Date of Patent: May 3, 2022

(54) SYSTEM AND METHOD OF DELIVERING SLURRY FOR CHEMICAL MECHANICAL POLISHING

(71) Applicant: Texas Instruments Incorporated, Dallas, TX (US)

(72) Inventors: Bassam Fouad Elkhatib, Frisco, TX (US); Kevin Don Vogel, Royse City, TX (US); Daniel Joseph Finch, Rowlett, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 143 days.

(21) Appl. No.: 15/183,942

(22) Filed: Jun. 16, 2016

(65) Prior Publication Data

US 2017/0361419 A1 Dec. 21, 2017

(51) Int. Cl.
*B24B 37/015* (2012.01)
*B24B 37/20* (2012.01)

(52) U.S. Cl.
CPC ..... *B24B 37/015* (2013.01); *B24B 37/20* (2013.01)

(58) Field of Classification Search
CPC ..... B24B 37/015; B24B 37/20; B24B 57/00; B24B 57/02; G01M 3/28; G01M 3/2807
See application file for complete search history.

(56) References Cited

U.S. PATENT DOCUMENTS 5,885,134 A * 3/1999 Shibata ..... B24B 55/12 451/41
6,000,997 A * 12/1999 Kao ..... B24B 37/015 451/53
6,106,728 A 8/2000 Iida et al.
6,257,955 B1 * 7/2001 Springer ..... B24B 37/015 451/446
6,315,635 B1 11/2001 Lin
RE38,215 E * 8/2003 Shibata ..... B24B 37/005 137/312
9,067,296 B2 6/2015 Ono et al.
2001/0003700 A1 * 6/2001 Mizuno ..... B24B 37/04 451/87

(Continued)

FOREIGN PATENT DOCUMENTS

SU 425771 A1 4/1974
WO WO2005005102 A1 1/2005

OTHER PUBLICATIONS

Notification of Transmittal of the International Search Report and the Written Opinion of the International Searching Authority, or the Declaration.

(Continued)

*Primary Examiner* — Joel D Crandall
(74) *Attorney, Agent, or Firm* — Andrew R. Ralston; Charles A. Brill; Frank D. Cimino

(57) ABSTRACT

A chemical mechanical polishing (CMP) system that includes a platen, a conduit having a heating segment and a delivery outlet, and a heater coupled to the heating segment of the conduit. The delivery outlet is positioned adjacent to the platen, whereas the heating segment defines a dispensing distance with the delivery outlet. The dispensing distance is associated with a stability of a CMP slurry at an elevated temperature that is above an ambient temperature.

23 Claims, 5 Drawing Sheets

(56) References Cited

U.S. PATENT DOCUMENTS

| | | | | |
|---|---|---|---|---|
| 2002/0036078 | A1* | 3/2002 | Janezich | F28F 9/06 165/164 |
| 2004/0087248 | A1* | 5/2004 | Hirokawa | B24B 37/015 451/7 |
| 2010/0015894 | A1* | 1/2010 | Ho | B24B 37/015 451/56 |
| 2014/0273746 | A1* | 9/2014 | Lai | B24B 37/005 451/1 |

OTHER PUBLICATIONS

English Machine Translation for SU425771A1, date requested Dec. 12, 2017, 2 pages.

* cited by examiner

SYSTEM AND METHOD OF DELIVERING SLURRY FOR CHEMICAL MECHANICAL POLISHING

BACKGROUND

Chemical mechanical polishing (CMP) is a process for smoothening an uneven surface (e.g., a post-metal deposition surface of a dielectric layer) of a semiconductor wafer during its fabrication process. In general, a chemical mixture (a.k.a. a CMP slurry) is used during the CMP process to help remove excessive materials that accumulate onto the uneven surface. The delivery of the CMP slurry may affect the efficiency of the CMP process because it takes time to warm up the CMP slurry to a temperature range where the CMP slurry may deliver the optimal performance. Moreover, this pre-heating process generates a significant amount of wasted CMP slurry, thereby driving up the overall cost of wafer fabrications.

To address these issues, attempts have been made to warm up the CMP slurry by using heated process water after the CMP slurry has been delivered to a polishing platform (e.g., a platen). This type of post-dispensary warming however, increases the risk of incurring pitting defects onto the processed wafer.

Attempts have been made to warm up the CMP slurry by increasing the downward polishing force during polishing. Yet, this type of mechanical warming increases the risk of scratching the processed wafer and reduces the consumable life of the polishing pad.

Further attempts have been made to warm up the CMP slurry while it is being circulated within a main supply loop and prior to any localized delivery. While this type of circulation pre-heating helps reduce the heating time of the CMP slurry at delivery, it may destabilize the composition of the CMP slurry when there is a relatively large time duration from the point of pre-heating to the point of use. Moreover, the costs for maintaining the CMP slurry at an elevated temperature can be relatively high when the circulation system is large.

SUMMARY

The present disclosure describes systems and methods for preconditioning a chemical mechanical polishing (CMP) slurry with a post-circulation and pre-dispensary scheme. The disclosed preconditioning scheme allows a CMP slurry to operate within a temperature range that optimizes its efficiency but without incurring the additional costs of process time or slurry waste.

In one implementation, for example, the present disclosure introduces a chemical mechanical polishing (CMP) system that includes a platen, a conduit having a heating segment and a delivery outlet, and a heater coupled to the heating segment of the conduit. The delivery outlet is positioned adjacent to the platen, whereas the heating segment defines a dispensing distance with the delivery outlet. The dispensing distance is associated with a stability of a CMP slurry at an elevated temperature that is above an ambient temperature.

In another implementation, for example, the present disclosure introduces a heating system for use in a chemical mechanical polishing (CMP) system. The heating system includes a heating element, a port, a thermal sensor, and a thermal control circuit. The heating element is mountable to a heating segment of a conduit for carrying a CMP slurry. The port is adjustable to introduce a coolant to a vicinity of the heating element. The thermal sensor is mountable to the conduit and downstream of the heating element, and the thermal sensor is configured to detect an elevated temperature of the CMP slurry. Coupled to the thermal sensor, the thermal control circuit is configured to regulate the heating element based on the elevated temperature and a target temperature, and it is further configured to adjust the port upon detecting the CMP slurry within the vicinity of the heating element.

In yet another implementation, for example, the present disclosure introduces a method for preconditioning a chemical mechanical polishing (CMP) slurry. The method includes conducting the CMP slurry along a conduit. The method also includes heating the CMP slurry while being conducted in the conduit, to a target temperature within a degradation time window before the CMP slurry is dispensed. In general, the degradation time window is sufficiently short to sustain a stability of the CMP slurry at an elevated temperature that is above an ambient temperature. The method further includes dispensing the heated CMP slurry to a CMP pad positioned on a platen.

DRAWING DESCRIPTIONS

Like reference symbols in the various drawings indicate like elements. Details of one or more implementations of the present disclosure are set forth in the accompanying drawings and the description below. The figures are not drawn to scale and they are provided merely to illustrate the disclosure. Specific details, relationships, and methods are set forth to provide an understanding of the disclosure. Other features and advantages may be apparent from the description and drawings, and from the claims.

DETAILED DESCRIPTION

Figure 1:
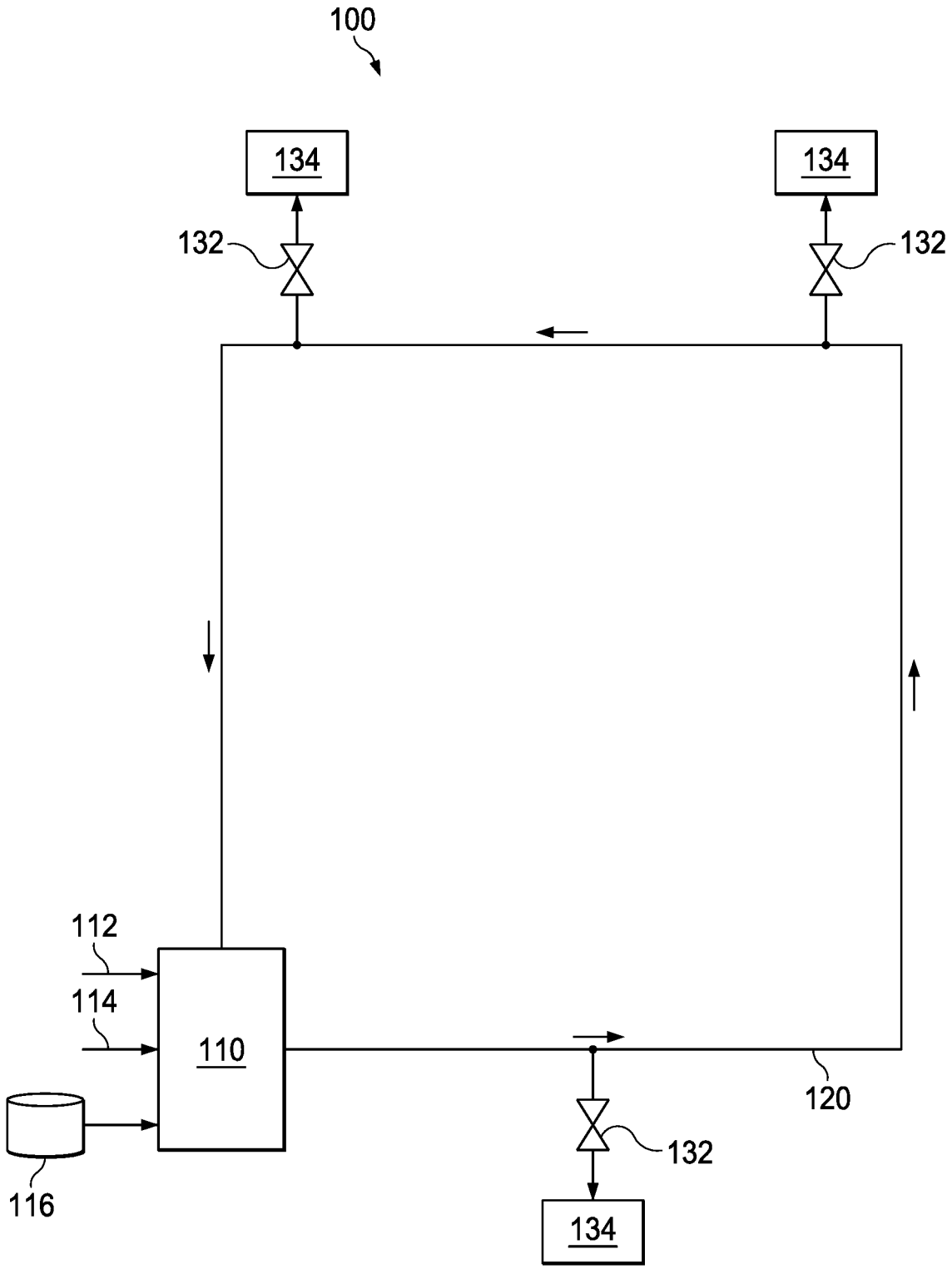
FIG. 1 shows a perspective view of a chemical mechanical polishing (CMP) slurry delivery system according to an aspect of the present disclosure.

FIG. 1 shows a perspective view of a chemical mechanical polishing (CMP) slurry delivery system 100 according to an aspect of the present disclosure. The CMP slurry delivery system 100 purports to precondition a CMP slurry with a post-circulation and pre-dispensary scheme. The disclosed preconditioning scheme allows a CMP slurry to operate within a temperature range that optimizes its efficiency but without incurring the additional costs associated with processing time or slurry waste. The CMP slurry delivery system 100 includes a CMP slurry mix unit 110 pumping mixed CMP slurry through a circulation pipe 120 and delivering the mixed CMP slurry to one or more local CMP stations 134.

The CMP slurry mix unit 110 receives concentrated CMP slurry from a CMP slurry drum 116. In general, the CMP slurry is used for removing excessive metal layers during the fabrication process of an integrated circuit, such that additional layers of dielectric material and/or metal wiring can be formed thereon. Depending on the compositions of the metal layers to be removed, the CMP slurry may include different types of active ingredients. For example, in a CMP process for removing palladium and nickel metal layers, a silicon dioxide based CMP slurry can be used. This type of CMP slurry may include additional active ingredients, such as benzotriazole (BTA), carbon oxide ether, and glycol ether.

The CMP slurry may be stored and transported in a CMP slurry drum 116, which is connected to the CMP slurry mix unit 110. The CMP slurry mix unit 110 is configured to prepare the CMP slurry at a certain concentration such that the CMP slurry can be applied at several local CMP stations 134. To that end, the CMP slurry mix unit 110 has a deionized water inlet 112 to receive deionize water and a hydrogen peroxide inlet 114 to receive a hydrogen peroxide solution. The CMP slurry mix unit 110 mix the active ingredients with the deionized water and the hydrogen peroxide solution. Then, the CMP slurry mix unit 110 pumps the mixed slurry into the circulation pipe 120 along a direction as indicated by the arrows in FIG. 1. When a local CMP station 134 is performing a CMP process, the respective local switch 132 is turned on to allow the circulating CMP slurry to be delivered to the local CMP station 134.

To enhance the efficiency of the CMP process, the CMP slurry is typically precondition to a target temperature (e.g., above 50° C.) before being applied to the surface of a wafer. This target temperature is kept under the flash point (e.g., 61° C.) to avoid igniting the CMP slurry. Once the temperature of the CMP slurry is increased from an ambient temperature (e.g., 25° C.) to an elevated temperature (e.g., greater than 25° C. and less than 61° C.), the CMP slurry may experience a time-dependent degradation, which may negatively impact its performance during the CMP process. In general, the magnitude of the CMP slurry degradation is proportional to a time duration for which the CMP slurry is preconditioned to the elevated temperature. Thus, the CMP delivery system 100 adopts a post-circulation preconditioning scheme, in which the CMP slurry undergoes a significant heating after it is being circulated and delivered to the local CMP station 134.

Figure 2:
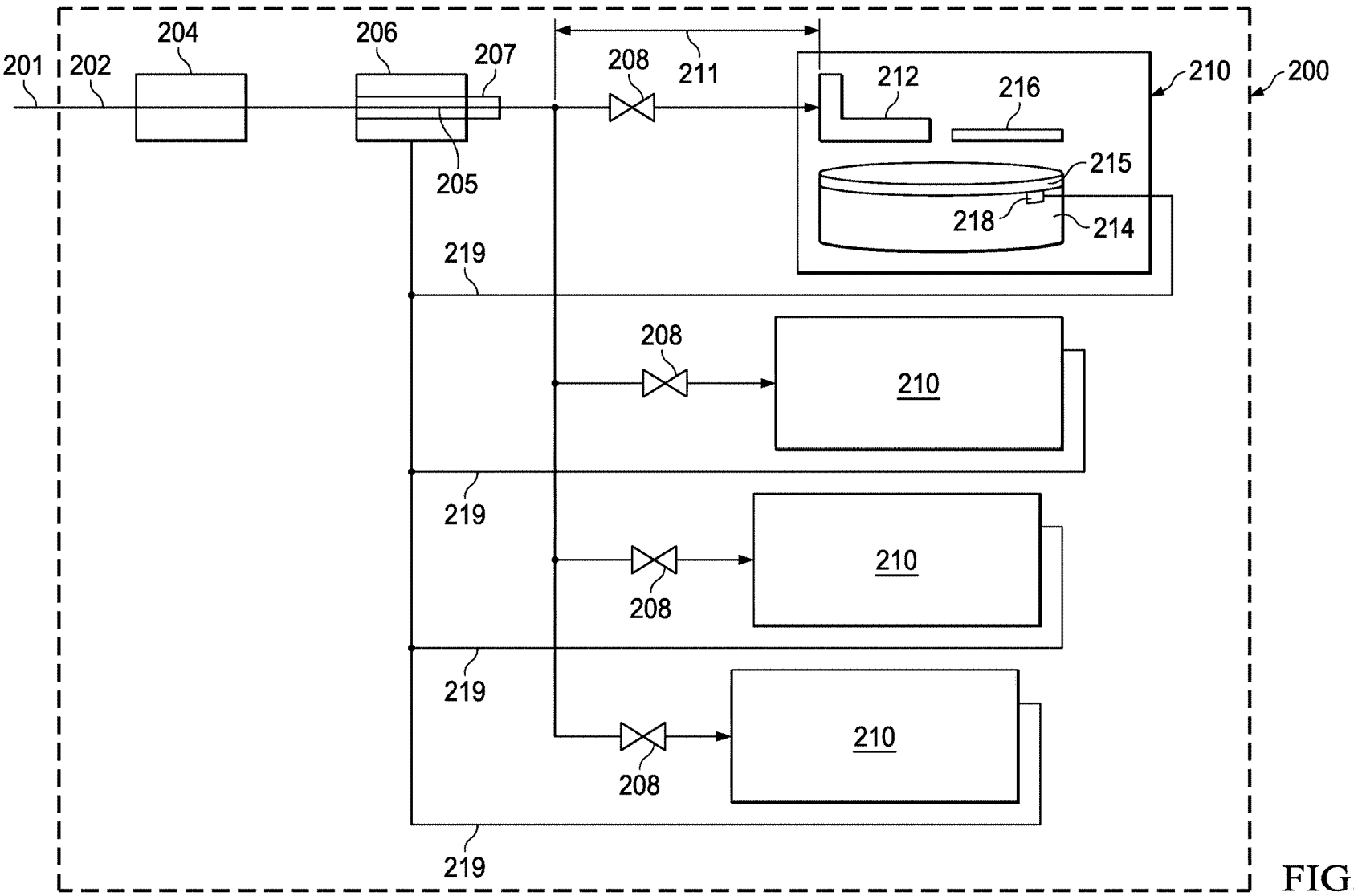
FIG. 2 shows a perspective view of a local CMP station according to an aspect of the present disclosure.

FIG. 2 shows a perspective view of a local CMP station 200 according to an aspect of the present disclosure. The local CMP station 200 provides an example for implementing the local CMP station 134 as shown and discussed in FIG. 1. The local CMP station 200 includes a local conduit 202, a slurry filter 204, a local heating system 206, and one or more CMP machines 210. In general, each CMP machine 210 includes a platen (i.e., a polishing platform) 214, a CMP slurry dispensing arm 212, and a CMP head 216. The platen 214 includes a CMP pad 215, which is used for polishing the surface of a wafer held up-side-down by the CMP head 216. The CMP slurry dispensing arm 212 serves as a delivery outlet. When a switch 208 is turned on, the corresponding CMP slurry dispensing arm 212 is configured to dispense the CMP slurry onto the CMP pad 215 before and during the CMP process. The platen 214 may be configured to warm up the CMP slurry after the slurry is dispensed by the CMP slurry dispensing arm 212 and before the CMP process begins. However, this post-dispensary scheme for preconditioning the CMP slurry may take as much as 1 minute before the CMP slurry reaches the target temperature. This delay in time translates to a significant amount of slurry waste because dispensed CMP slurry that is below the target temperature is typically discarded before even being used.

To reduce the CMP slurry waste, the present disclosure provides a pre-dispensary scheme for preconditioning the CMP slurry. This pre-dispensary scheme deploys the local heating system (a.k.a. slurry heater) 206 to heat the CMP slurry to a target temperature before the CMP slurry is dispensed onto the CMP pad 215 of the platen 214. Advantageously, the disclosed pre-dispensary scheme helps reduce the CMP process time, save on CMP slurry usage, and improve the capacity of the local CMP station 210. Consistent with these advantages, the disclosed pre-dispensary scheme does not prohibit or preclude any post-dispensary heating of the CMP slurry so long as the temperature of the CMP slurry has augmented from an ambient temperature to an elevated temperature before being dispensed onto the CMP pad 215. For instance, the CMP slurry may experience a temperature drop after it is dispensed onto the CMP pad 215 even though the CMP slurry has been pre-heated to or above the target temperature before being dispensed. In this case, the CMP slurry may be heated post-dispensary to recover from the temperature drop.

When the local CMP station is in an operation mode, the conduit inlet 201 of the local conduit 202 receives the CMP slurry from the circulation pipe 120 as shown and described in FIG. 1. The received CMP slurry is then processed by the slurry filter 204, which is coupled to the local conduit 202 and positioned upstream of the slurry heater 206. The slurry filter 204 is thus in fluidic communication with the local conduit 202 to remove impurities added to the CMP slurry while it is being circulated. After removing the impurities, the heating process of the CMP slurry can be more accurately monitored and controlled. The local conduit 202 has a heating segment 205 onto which the slurry heater 206 is mounted. The slurry heater 206 is thermally coupled to the heating segment 205 of the local conduit 202. The slurry heater 206 is configured to heat the CMP within the heating segment 205 and to a target temperature that is suitable for performing the CMP process.

In one aspect, the target temperature is below a flash point of the CMP slurry. For instance, if the CMP slurry includes the active ingredients as described above, the target temperature is below 60° C. In another aspect, the target temperature may include a range in which the CMP slurry can deliver an optimal performance upon being dispensed onto the CMP pad 215. For instance, if the CMP slurry includes the active ingredients as described above, the target temperature may include a range from 50° C. to 60° C. This target temperature range may be adjusted in anticipation of a temperature drop as the CMP slurry travels from the heating segment 205 onto the CMP pad 215 of the platen 214. For instance, if a 5° C. drop is anticipated, the target temperature may include a range from 55° C. to 60° C. instead.

Figure 3:
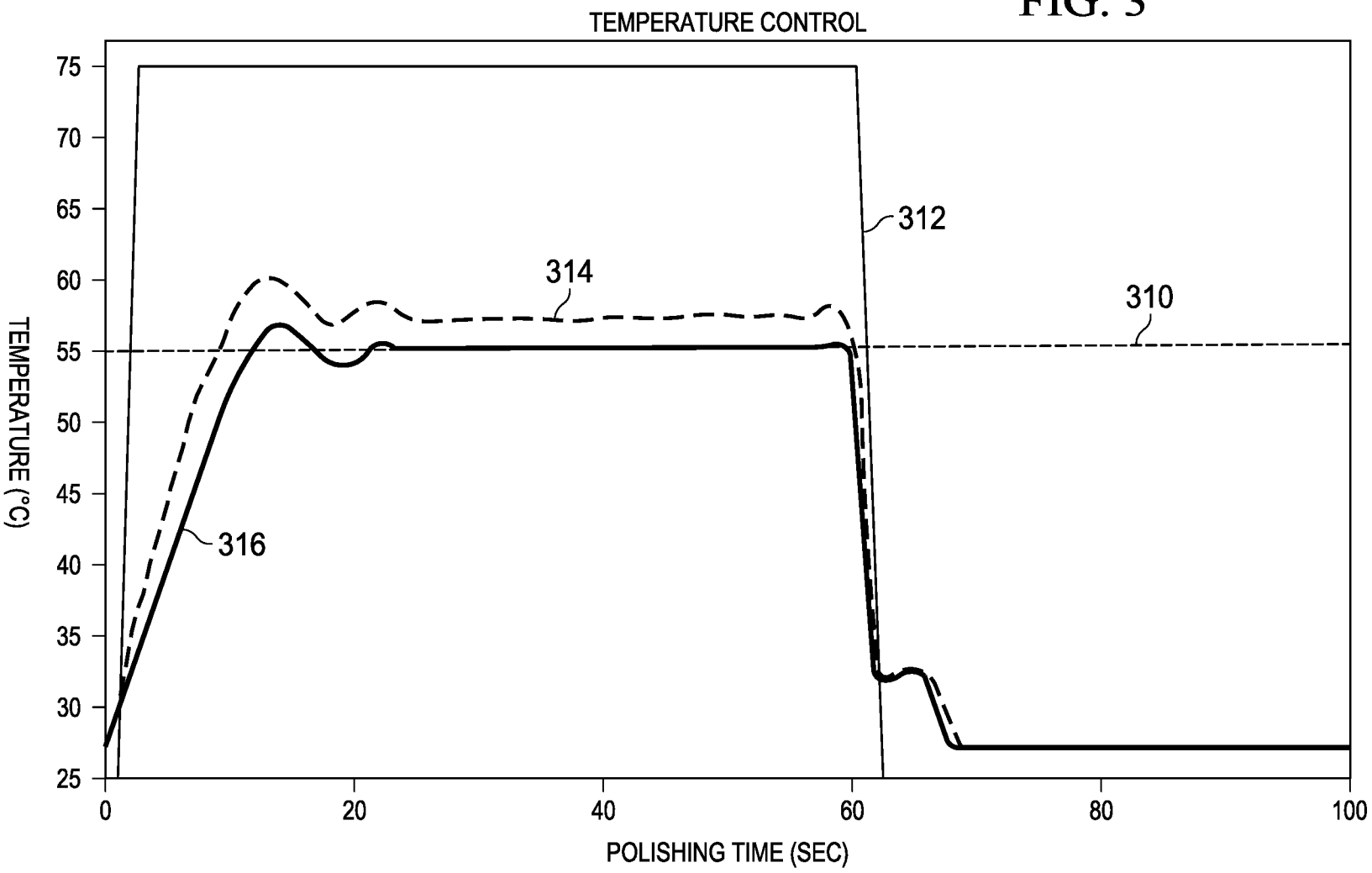
FIG. 3 shows a temperature control chart of a CMP heating system according to an aspect of the present disclosure.

As shown in FIG. 3, the slurry heater 206 is configured to deliver a heater output temperature 312, which is used for heating the CMP slurry within the heating segment 205 to a heater outlet temperature 314, which likely represents the peak of the elevated temperature. In one aspect, the heater outlet temperature 314 may be the same as a platen surface temperature 316 if the CMP slurry experiences no temperature drop as it travels from the heating segment 205 onto the CMP pad 215 of the platen 214. In another aspect, the heater outlet temperature 314 may be a few degrees Celsius (e.g., 5° C.) higher than the platen surface temperature 316 if the CMP slurry is anticipated to have a temperature drop as it travels from the heating segment 205 onto the CMP pad 215 of the platen 214. Either way, the platen surface temperature 316 is configured to reach a CMP process temperature (e.g., a target temperature) 310, which may ranges from 50° C. to 60° C. In one implementation, for example, the CMP process temperature 310 is set at 55° C.

Referring again to FIG. 2, the local conduit 202 has a delivery outlet, such as the CMP slurry dispensing arm 212, which is positioned adjacent to the platen 214. The heating segment 205 defines a dispensing distance 211 with the delivery outlet (e.g., the CMP slurry dispensing arm 212). To avoid slurry degradation, the CMP slurry is preferred to remain stable while traveling the dispensing distance 211 and before being dispensed onto the CMP pad 215 of the platen 214. Hence, the dispensing distance 211 can be associated with a stability of the CMP slurry when the CMP slurry is at an elevated temperature above t ambient temperature. For instance, if the target temperature is 55° C. and the ambient temperature is 25° C., then the elevated temperature may be between 25° C. and 55° C. with a +/−1° C. of margin. In general, the stability of the CMP slurry decreases with an increasing dispensing distance 211 as it prolongs the CMP slurry travel time, which in turn, allows the CMP slurry to degrade further before reaching the CMP pad 215.

Hence, the stability of the CMP slurry can be represented by a degradation time window associated with the elevated temperature. In one aspect, the degradation time window is approximated by the dispensing distance 211 measured from a heating segment 205 of the local conduit 202, in which the CMP slurry is heated, to a delivery outlet of the local conduit 202 from, from which the CMP slurry is dispensed. Thus, the dispensing distance 211 is sufficiently short, such that the CMP slurry can be conducted by the local conduit 202 from the heating segment 205 to the delivery outlet (e.g., 212) for less than the degradation time window. In one implementation, for example, the dispensing distance 211 is less than 10 m when the degradation time window is less than 10 minutes. In another implementation, for example, the dispensing distance 211 is less than 5 m when the degradation time window is less than 4 minutes. In yet another implementation, for example, the dispensing distance 211 is less than 3 m when the degradation time window is between 1.5 minutes and 2 minutes.

The local CMP station 200 also includes one or more temperature control mechanism for regulating the heater outlet temperature 314 and/or the platen surface temperature 316. In one implementation, the local CMP station 200 includes a heater outlet thermal sensor 207, which is thermally coupled to the heating segment 205 of the local conduit 202. The heater outlet thermal sensor 207 can be a part of the local heating system 206, and the sensor 207 is configure to detect the temperature of the CMP slurry after it is being elevated from an ambient temperature. For instance, the heater outlet thermal sensor 207 may be configured to detect the heater outlet temperature 314 as shown and described in FIG. 3.

The local heating system 206 is configured to regulate the heater output temperature 312 based on the target temperature and the elevated temperature detected by the heater outlet thermal sensor 207. More specifically, the local heating system 206 is configured to increase the heater output temperature 312 where the elevated temperature is significantly below (e.g., 5° C. or more) the target temperature (e.g., 310); conversely, the local heating system 206 is configured to decrease the heater output temperature 312 where the elevated temperature is significantly above (e.g., 5° C. or more) the target temperature (e.g., 310).

In another implementation, the local CMP station 200 includes a platen thermal sensor 218, which is thermally coupled to the CMP pad 215 of the platen 214. The platen thermal sensor 218 can be a part of the local heating system 206, or the sensor 218 can be coupled to the local heating system 206 via a thermal feedback connection 219. When enabled, the sensor 218 is configure to detect a surface temperature of the CMP pad 215. For instance, the platen thermal sensor 218 may be configured to detect the platen surface temperature 316 as shown and described in FIG. 3.

The local heating system 206 is configured to regulate the heater output temperature 312 based on the target temperature and the platen surface temperature 316 detected by the platen thermal sensor 218. More specifically, the local heating system 206 is configured to increase the heater output temperature 312 where the platen surface temperature 316 is significantly below (e.g., 5° C. or more) the target temperature (e.g., 310); conversely, the local heating system 206 is configured to decrease the heater output temperature 312 where the platen surface temperature 316 is significantly above (e.g., 5° C. or more) the target temperature (e.g., 310).

Figure 4:
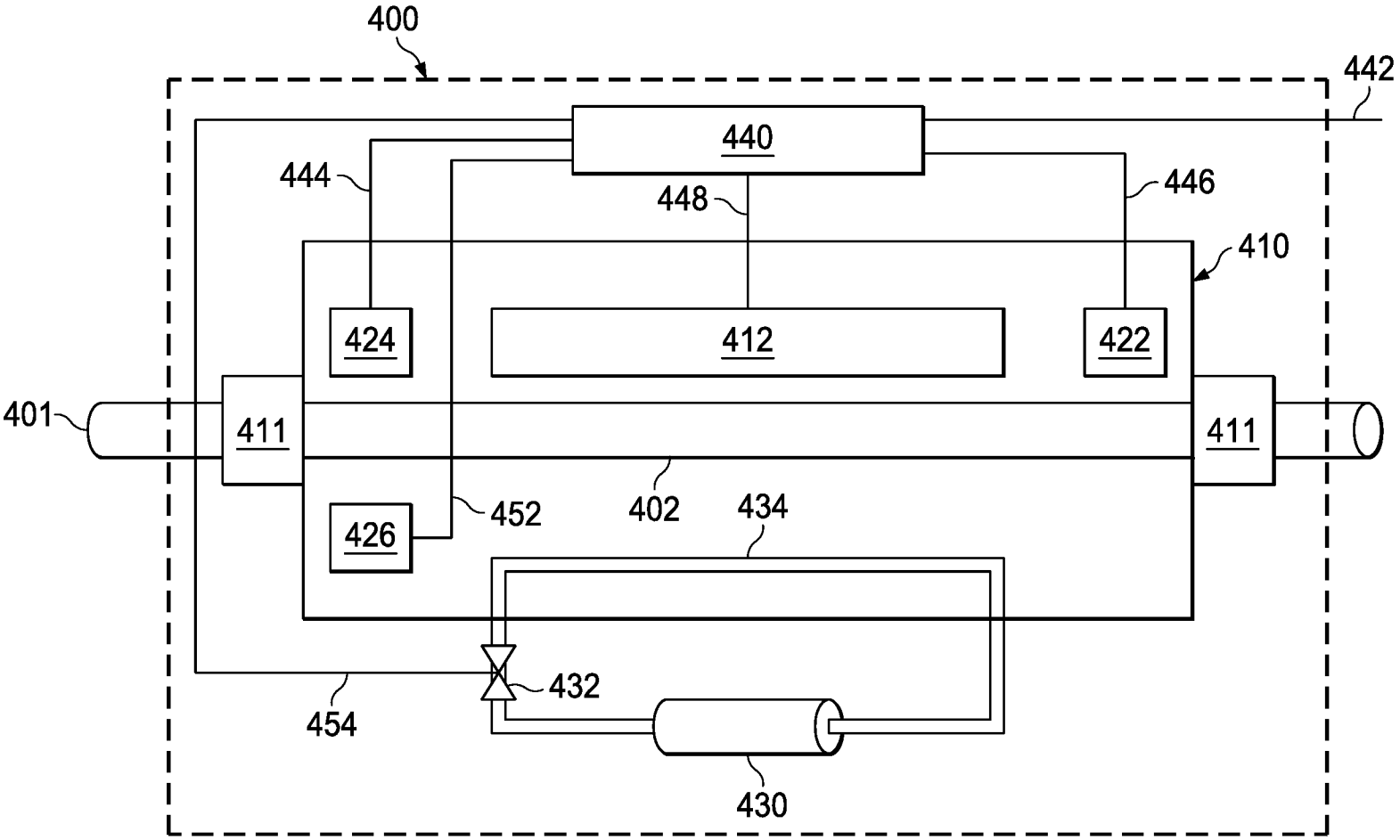
FIG. 4 shows a perspective view of a CMP heating system according to an aspect of the present disclosure.

FIG. 4 shows a perspective view of a CMP heating system 400 according to an aspect of the present disclosure. The CMP heating system 400 may be used for implementing the local heating system 206 as shown and described in FIGS. 2-3. The CMP heating system 400 includes a heating element 412 that can be mounted to the heating segment 402 of a local conduit 401. In one implementation, for instance, the CMP heating system 400 includes an heater assembly 410 with one or more mounting screws 411 that can be tighten for mounting the heating element 412 to the heating segment 402 of the local conduit 401. The heating element 412 includes an electrical component, which is shielded from contacting the CMP slurry while providing heat energy to the CMP slurry.

The CMP heating system 400 includes a first thermal sensor 422 that is thermally coupled to the heating segment 402. Or more precisely, the first thermal sensor 422 is thermally coupled to an outlet portion of the heating segment 402, such that the first thermal sensor 422 is positioned downstream of the heating element 412. When enabled, the first thermal sensor 422 is configured to detect an elevated temperature of the CMP slurry.

The CMP heating system 400 includes a thermal control circuit 440, which can be an integrated circuit or a circuit formed on a printed circuit board (PCB). The thermal control circuit 440 is coupled to the first thermal sensor 422 via an outlet sense connection 446, which can be wired or wireless. The thermal control circuit 440 is also coupled to the heating element 412 via a heater control connection 448, which can be wired or wireless. Upon receiving data representing the elevated temperature from the first thermal sensor 422, the thermal control circuit 440 is configured to regulate the heating element 412 based on the elevated temperature and a target temperature in a manner consistent with the descriptions and illustrations of FIGS. 2-3. In one aspect, the thermal control circuit 440 is configured to increase the power output of the heating element 412 when the elevated temperature is significantly below (e.g., 5° C. or more) the target temperature. In another aspect, the thermal control circuit is configured to reduce the power output of the heating element 412 when the elevated temperature is significantly above (e.g., 5° C. or more) the target temperature.

Additionally, the thermal control circuit 440 may receive data representing the platen surface temperature (e.g., 316) from a thermal feedback connection 442, which can be wired or wireless. The thermal control circuit 440 is configured to regulate the heating element 412 based on the platen surface temperature and the target temperature in a manner consistent with the descriptions and illustrations of FIGS. 2-3. In one aspect, the thermal control circuit 440 is configured to increase the power output of the heating element 412 when the platen surface temperature is significantly below (e.g., 5° C. or more) the target temperature. In another aspect, the thermal control circuit is configured to reduce the power output of the heating element 412 when the platen surface temperature is significantly above (e.g., 5° C. or more) the target temperature.

The CMP heating system 400 includes a second thermal sensor 424 that is thermally coupled to the heating element 412. When enabled, the second thermal sensor 424 is configured to detect the heater output temperature (e.g., 312) of the heating element 412. The thermal control circuit 440 is coupled to the second thermal sensor 424 via a heater sense connection 444. Upon receiving data representing the heater output temperature from the second thermal sensor 424, the thermal control circuit 440 is configured to regulate the heating element 412 to avoid over-heating the CMP slurry.

The CMP slurry heating system 400 also includes a cooling subsystem to alleviate potential fire risks associated with a leakage of the CMP slurry. Because the CMP slurry may have a flash point lower than the heater output temperature (e.g., 312) of the heating element 412, the CMP slurry can be ignited once it is leaked from the heating segment 402 to enter an unshielded portion of the heater assembly 410. The cooling subsystem purports to substantially reduce the temperature of the leaked CMP slurry below its flash point so as to prevent the leaked CMP slurry from being ignited.

The cooling subsystem includes a leak detector 426, an adjustable port 432, a coolant container 430, and a coolant delivery pipe 434. The coolant container 430 stores a coolant, such as liquid nitrogen, outside of the heater assembly 410. The leak detector 426 is positioned to detect the CMP slurry leaking into the vicinity of the heating element 412. It can be understood that the vicinity of the heating element is within a flammable range of the leaked CMP slurry, which may include the interior of the heater assembly 410. The leak detector 426 may include a liquid level sensor positioned within the heater assembly 410. The leak detector 426 is coupled to the thermal control circuit 440 via a leak detect connection 452, which can be wired or wireless. Upon receiving data from the leak detector 426, the thermal control circuit 440 determines whether or not the CMP slurry has leaked and breached within the vicinity of the heating element 412. If the leaked CMP slurry is determined to be within the vicinity of the heating element 412, the thermal control circuit 440 is configured to adjust the adjustable port 432.

The thermal control circuit 440 is coupled to the adjustable port 432 via a coolant control connection 454, which can be wired or wireless. The thermal control circuit 440 can be configured to open the adjustable port 432. As a result, the adjustable port 432 will introduce the coolant from the coolant container 432 to the coolant delivery pipe 434, which is routed to the vicinity of the heating element 412. In one implementation, for example, the vicinity of the heating element 412 may be within a radial distance of 1 cm from the heating element 412. In another implementation, for example, the vicinity of the heating element 412 may be within a radial distance of 2 cm from the heating element 412.

Figure 5:
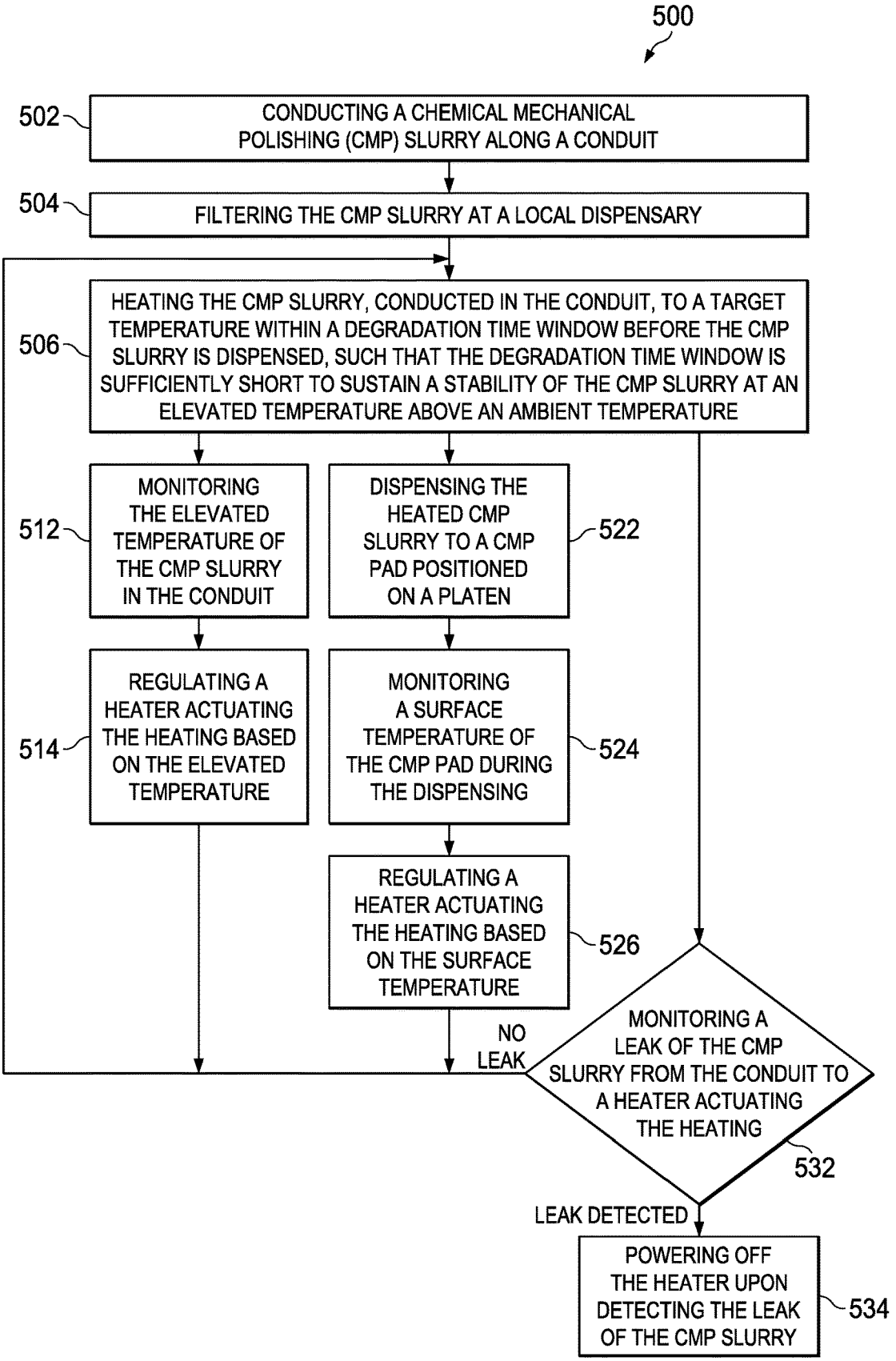
FIG. 5 shows a flow diagram of a method for performing a CMP process according to an aspect of the present disclosure.

FIG. 5 shows a flow diagram of a method 500 for performing a CMP process according to an aspect of the present disclosure. The method 500 can be implemented for operating the CMP slurry delivery system 100, the local CMP station 200, and/or the CMP slurry heating system 400 as shown and described in FIGS. 1-4. The method 500 begins at step 502, which involves conducting a CMP slurry along a conduit (e.g., the local conduit 202). Then the method 500 proceeds to step 504, which involves filtering the CMP slurry at a local dispensary (e.g., the local CMP station 200). For example, step 504 may be performed by the slurry filter 204 positioned upstream of the local heating system 206. Next, the method 500 proceeds to step 506, which involves heating the CMP slurry, conducted in the conduit, to a target temperature within a degradation time window before the CMP slurry is dispensed, such that the degradation time window is sufficiently short to sustain a stability of the CMP slurry at an elevated temperature above an ambient temperature.

Consistent with the descriptions and illustrations of FIGS. 2-3, the target temperature may range from 50° C. to 60° C., and it may be set below a flash point of the CMP slurry. The degradation time window is a function of the elevated temperature. When the elevated temperature is significantly high than (e.g., 10%) the target temperature, the degradation time window ranges between 1.5 minutes and 2 minutes. When the elevated temperature is slightly higher than (e.g., 5%) the target temperature, the degradation time window may be less than 4 minutes. When the elevated temperature is within a close margin (e.g., 2%) of the target temperature, the degradation time window may be less than 10 minutes.

Moreover, the degradation time window can be approximated by a dispensing distance (e.g., 211) measured from a heating segment (e.g., 205) of the local conduit (e.g., 202) in which the CMP slurry is heated and to a delivery outlet (e.g., 212) of the conduit from which the CMP slurry is dispensed. In one implementation, for example, the dispensing distance is less than 10 m when the degradation time window is less than 10 minutes. In another implementation, for example, the dispensing distance is less than 5 m when the degradation time window is less than 4 minutes. In yet another implementation, for example, the dispensing distance is less than 3 m when the degradation time window is between 1.5 minutes and 2 minutes.

Next, the method 500 may concurrently and selectively perform one or more regulation procedures. The first regulation procedure includes step 512 and step 514. Step 512 involves monitoring the elevated temperature of the CMP slurry in the conduit. As an example, step 512 may be performed by the heater outlet thermal sensor 207 in FIG. 2 or the first thermal sensor 422 in FIG. 4 and consistent with the description thereof. Step 514 involves regulating a heater actuating the heating based on the elevated temperature. As an example, step 514 can be performed by the local heating system 206 in FIG. 2 or the thermal control circuit 440 in FIG. 4 and consistent with the description thereof.

The second regulation procedure includes steps 522, step 524, and step 526. Step 522 involves dispensing the heated CMP slurry to a CMP pad (e.g., 212) positioned on a platen (e.g., 214). Step 524 involves monitoring a surface temperature of the CMP pad during the dispensing. As an example, step 524 can be performed by the platen thermal sensor 218 in FIG. 2 and consistent with the description thereof. Step 526 involves regulating a heater actuating the heating based on the surface temperature. As an example, step 514 can be performed by the local heating system 206 in FIG. 2 or the thermal control circuit 440 in FIG. 4 and consistent with the description thereof.

The third regulation procedure includes steps 532 and 534. Step 532 involves monitoring a leak of the CMP slurry from the conduit to a heater actuating the heating. As an example, step 532 can be performed by the leak detector 426 in FIG. 4 and consistent with the description thereof. Step 534 involve powering off the heater upon detecting the leak of the CMP slurry. As an example, step 534 can be performed by the thermal control circuit 440 in FIG. 4 and consistent with the description thereof. Additionally, step 534 may also involve introducing a coolant to the heater upon detecting a leak of the CMP slurry to prevent the leaked CMP slurry from being ignited. As an example, step 534 can be performed by the coolant subsystem (e.g., 430, 432, and 434) in FIG. 4 and consistent with the description thereof.

Consistent with the present disclosure, the term "configured to" purports to describe the structural and functional characteristics of one or more tangible non-transitory components. For example, the term "configured to" can be understood as having a particular configuration that is designed or dedicated for performing a certain function. Within this understanding, a device is "configured to" perform a certain function if such a device includes tangible non-transitory components that can be enabled, activated, or powered to perform that certain function. While the term "configured to" may encompass the notion of being configurable, this term should not be limited to such a narrow definition. Thus, when used for describing a device, the term "configured to" does not require the described device to be configurable at any given point of time.

Moreover, the term "exemplary" is used herein to mean serving as an example, instance, illustration, etc., and not necessarily as advantageous. Also, although the disclosure has been shown and described with respect to one or more implementations, equivalent alterations and modifications will be apparent upon a reading and understanding of this specification and the annexed drawings. The disclosure comprises all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application While this specification contains many specifics, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results unless such order is recited in one or more claims. In certain circumstances, multitasking and parallel processing may be advantageous. Moreover, the separation of various system components in the embodiments described above should not be understood as requiring such separation in all embodiments.

What is claimed is:

1. A chemical mechanical polishing (CMP) system, comprising:

a platen;

a conduit having a heating segment and a delivery outlet, the delivery outlet positioned adjacent to the platen, the heating segment defining a dispensing distance with the delivery outlet;

a heater coupled to the heating segment of the conduit and having a heating element;

a cooling subsystem coupled to the heating segment of the conduit; and a thermal control circuit coupled to the heater and the cooling subsystem and configured to regulate the heater based on an elevated temperature and a target temperature of a CMP slurry within the conduit, and configured to adjust a coolant port to introduce a coolant to the heater upon detecting the CMP slurry within the vicinity of the heating element.

2. The CMP system of claim 1, wherein the dispensing distance is associated with a stability of the CMP slurry at an elevated temperature above an ambient temperature.

3. The CMP system of claim 1, wherein the dispensing distance is less than five meters.

4. The CMP system of claim 1, wherein the heater is configured to heat the CMP slurry within the heating segment to a target temperature.

5. The CMP system of claim 4, wherein the target temperature is below a flash point of the CMP slurry.

6. The CMP system of claim 4, wherein the target temperature ranges from 50° C. to 60° C.

7. The CMP system of claim 1, wherein the heating element is attached to the heating segment of the conduit, and the heater includes a thermal sensor coupled to the thermal control unit and to the conduit and positioned downstream of the heating element, the thermal sensor configured to detect an elevated temperature of the CMP slurry above an ambient temperature, wherein the thermal control circuit is further configured to regulate the heating element based on a target temperature and the elevated temperature detected by the thermal sensor.

8. The CMP system of claim 1, further comprising:

a CMP pad positioned on the platen; and a thermal sensor coupled to the thermal control circuit and configured to detect a surface temperature of the CMP pad, wherein the heater includes a heating element mounted to the heating segment of the conduit, and the thermal control circuit is configured to regulate the heating element based on the surface temperature detected by the thermal sensor.

9. The CMP system of claim 1, further comprising:

a slurry filter coupled to the conduit and positioned upstream of the heater.

10. A heating system for use in a chemical mechanical polishing (CMP) system, the heating system comprising:

a heating element mountable to a heating segment of a conduit for carrying a CMP slurry;

a port adjustable to introduce a coolant to a vicinity of the heating element;

a thermal sensor mountable to the conduit and downstream of the heating element, the thermal sensor configured to detect an elevated temperature of the CMP slurry; and a thermal control circuit coupled to the thermal sensor, the thermal control circuit configured to regulate the heating element based on the elevated temperature and a target temperature, and configured to adjust the port upon detecting the CMP slurry within the vicinity of the heating element.

11. The heating system of claim 10, further comprising:

a container storing the coolant, the container coupled to the port for delivering the coolant to the vicinity of the heating element.

12. The heating system of claim 10, further comprising:

a leak detector positioned to detect the CMP slurry leaking into the vicinity of the heating element, wherein the thermal control circuit is coupled to the leak detector, and the thermal control circuit is configured to open the port upon the leaking is detected by the leak detector.

13. The heating system of claim 10, further comprising:

a second thermal sensor configured to detect a surface temperature of a CMP pad, wherein the thermal control circuit is coupled to the second thermal sensor, the thermal control circuit is configured to regulate the heating element based on the surface temperature detected by the second thermal sensor.

14. The heating system of claim 10, wherein the heating element includes an electrical heating element mountable to the heating segment of the conduit and shielded from contacting the CMP slurry.

15. A chemical mechanical polishing (CMP) system, comprising:

a platen;

a conduit having a heating segment and a delivery outlet, the delivery outlet positioned adjacent to the platen, the heating segment defining a dispensing distance with the delivery outlet;

a heater coupled to the heating segment of the conduit;

a cooling subsystem coupled to the heating segment of the conduit; and a thermal control circuit coupled to the heater and the cooling subsystem and configured to power off the heater and introduce a coolant to the heater in the event a CMP slurry leak is detected.

16. A method of forming an integrated circuit, comprising:

providing a wafer to a chemical mechanical polishing (CMP) tool platen, the wafer having a material layer thereover;

directing a CMP slurry to the platen and removing a portion of the material layer with the slurry, the slurry being directed via a conduit having a heating segment and a delivery outlet, the delivery outlet positioned adjacent to the platen;

the heating segment of the conduit coupled to a heater having a heating element;

a cooling subsystem coupled to the heating segment of the conduit; and a thermal control circuit coupled to the heater and the cooling subsystem and configured to regulate the heater based on an elevated temperature and a target temperature of a CMP slurry within the conduit, and configured to adjust a coolant port to introduce a coolant to the heater upon detecting the CMP slurry within the vicinity of the heating element.

17. The method of claim 16 wherein the target temperature ranges from ranges from 50° C. to 60° C.

18. The method of claim 16, wherein the target temperature is below a flash point of the CMP slurry.

19. The method of claim 16, further comprising:

monitoring a surface temperature of the CMP pad during the dispensing; and regulating the heater based on the surface temperature.

20. The method of claim 16, further comprising:

filtering the CMP slurry before heating the CMP slurry.

21. The method of claim 16, further comprising cooling the CMP slurry with the coolant in the event the leak is detected.

22. A method of forming an integrated circuit, comprising:

providing a wafer to a chemical mechanical polishing (CMP) tool platen;

directing a CMP slurry to the platen and using the CMP tool to polish the wafer with the slurry, the slurry being directed via a conduit having a heating segment and a delivery outlet positioned adjacent to the platen;

the heating segment of the conduit coupled to a heater;

a thermal control circuit coupled to the heater and a cooling subsystem and configured to direct a coolant to the heater upon detecting the CMP slurry within the vicinity of the heater element.

23. A method of forming an integrated circuit, comprising:

providing a wafer to a chemical mechanical polishing (CMP) tool platen;

directing a CMP slurry to the platen and polishing the wafer on the platen with the slurry, the slurry being directed via a conduit having a heating segment and a delivery outlet positioned adjacent to the platen;

the heating segment of the conduit coupled to a heater;

a thermal control circuit coupled to the heater and a cooling subsystem configured to direct a coolant to the heater upon the CMP slurry being detected within the vicinity of the heater element.

* * * * *